US006389861B1

(12) United States Patent
Bagusche et al.

(10) Patent No.: US 6,389,861 B1
(45) Date of Patent: May 21, 2002

(54) ROLLER CAGE

(75) Inventors: Siegfried Bagusche, Erkelenz; Herbert Kalb, Huckelboven; Frank Risters, Erkelenz; Hans Zimmerman, Selfkaol, all of (DE)

(73) Assignee: Hegenscheidt-MFD Gm H & Co. KG, Erkelenz (DE)

( * ) Notice: Subject to any disclaimer, the term of this patent is extended or adjusted under 35 U.S.C. 154(b) by 0 days.

(21) Appl. No.: 09/748,891

(22) Filed: Dec. 27, 2000

(30) Foreign Application Priority Data

Aug. 28, 2000 (DE) ..... 100 42 425

(51) Int. Cl.[7] ..... B21D 15/00
(52) U.S. Cl. ..... 72/110; 72/463
(58) Field of Search ..... 72/102, 107, 109, 72/110, 111, 462, 463; 384/523, 572, 623

(56) References Cited

U.S. PATENT DOCUMENTS 5,445,003 A * 8/1995 Gottschalk et al. ..... 72/107
5,699,692 A * 12/1997 Lonero et al. ..... 72/463
6,253,590 B1 * 7/2001 Lonero et al. ..... 72/107
6,257,037 B1 * 7/2001 Lonero et al. ..... 72/110

* cited by examiner

*Primary Examiner*—Ed Tolan
(74) *Attorney, Agent, or Firm*—Carlson, Gaskey & Olds

(57) ABSTRACT

A roller cage (1) is provided with a prismatic base body for guiding a minimum of one work roller designed for deep rolling of grooves on crankshaft journals or crank pins, in a first (7, 8) concave recess on one of the two faces (5) of the prismatic body on a section of the circumference of the work roller, wherein the rotational axis of the work roller is inclined at an angle (10), in which the section guided inside the roller cage (1) has a shorter distance to the longitudinal center (C—C) of the prismatic body than the remaining section with a first, groove shaped recess (11) along the longitudinal center (C—C) of the base area (3) of the prismatic body, as a passage for one support roller for the work roller, and a second groove shaped recess (12) along the longitudinal center (C—C) on the side (2) of the prismatic body located opposite the first groove shaped recess (11), for support of the roller cage (1) on the end of the long leg of an L-shaped tool holder, by providing on the second face of the prismatic body (1) located opposite the first concave recess (7, 8), a minimum of one second concave recess identical by position and size to the first concave recess (7, 8).

5 Claims, 1 Drawing Sheet

ROLLER CAGE

RELATED APPLICATIONS

The application claims priority to German Patent Application No. 10042425.2, filed Aug. 28, 2000.

BACKGROUND OF THE INVENTION

This invention concerns a roller cage which is part of a tool designed for deep rolling of grooves on crankshaft journals or crank pins. Such a tool is known in the art, for example, from EP 0 839 607 A1. The roller cage is guided at the end of an L-shaped tool holder.

Work rollers are known in the art, for example, from U.S. Pat. No. 5,806,184. Two work rollers are guided inside each of the roller cages and inclined at an angle. The slope is selected so that the sections of the work rollers guided inside the roller cage have a smaller distance from the longitudinal center of the deep rolling tool than those sections of the work rollers that are located outside the roller cages.

The physical roller cage has rather small dimensions. Its base area is, for example, only 10 to 30 mm wide and 10 to 15 mm long. The height of the prismatic base body is between 8 and 15 mm. These dimensions apply to a tool appropriate for the processing of crankshafts for passenger car engines.

The work rollers are made of hardened steel while the roller cages consist of bronze which, along with minimal wear, has especially favorable sliding characteristics. But other materials may also be considered for the roller cage, such as titanium or ceramics.

Nevertheless, roller cages are subject to a high level of wear which results in their relatively short tool life. With progressive wear of the roller cages, however, work rollers are also subject to wear. This stress pattern eventually requires roller cages and work rollers always to be replaced at the same time, when wear on the roller cage alone has reached a certain extent.

SUMMARY OF THE INVENTION

The object of this invention calls for an increase in the useful life of a roller cage to achieve an increase in the service life of the deep rolling tool as a unit, yet using one and the same work roller.

It was found that this object may be attained by providing a minimum of one second concave recess identical in position and size to the first concave recess, on the second face of the prismatic body opposite the first concave recess, for guiding the work roller.

When wear of the first concave recess for guiding the work roller has reached a certain depth, the roller cage is reversed within the tool, and the work roller with then be guided in the second concave recess provided on the rear face of the roller cage until the permissible level of wear is reached there also. The result is the improved utilization of the roller cage. Due to its small dimensions, the required precision and its multiple machining operations, such a roller cage represents a highly complex component of the tool whose manufacturing costs are high, accordingly. Due to the improved utilization of this component based on the invention, the overall economy of the deep rolling tool can be increased.

As shown in the above mentioned state of the art, it is customary to guide two work rollers inside of one single roller cage simultaneously. This arrangement applies to crankshafts on which each journal is followed by one crank pin. With crankshafts having two adjacent crank pins, though, the so-called split crankshafts, it is also customary to operate with only one single work roller inside one roller cage. This invention is to cover these applications also. For this purpose the first and second concave recess on the first and second face of the prismatic body are provided as mirror images of each other relative to the body's longitudinal center.

On the external end of the L-shaped tool holder each roller cage is guided in a tongue shaped extension of the tool holder. This tongue shaped extension engages a longitudinal groove of the prismatic body of the roller cage so as to provide the bottom of the entire deep rolling tool with a plain edge from which only the non-guided sections of the work rollers protrude. The engagement between the roller cage and the L-shaped tool holder requires the longitudinal groove inside the roller cage to have a certain slope. Since in the case at hand the roller cage is to be utilized from both faces, design provisions call for the slope to drop toward both face areas of the roller cage. With the help of these means, a particularly simple and effective roller cage mount is accomplished.

BRIEF DESCRIPTION OF THE DRAWINGS

The following is a description of the invention based on one embodiment. Using an enlarged scale the following is shown.

DETAILED DESCRIPTION OF THE PREFERRED EMBODIMENTS

Figure 1:
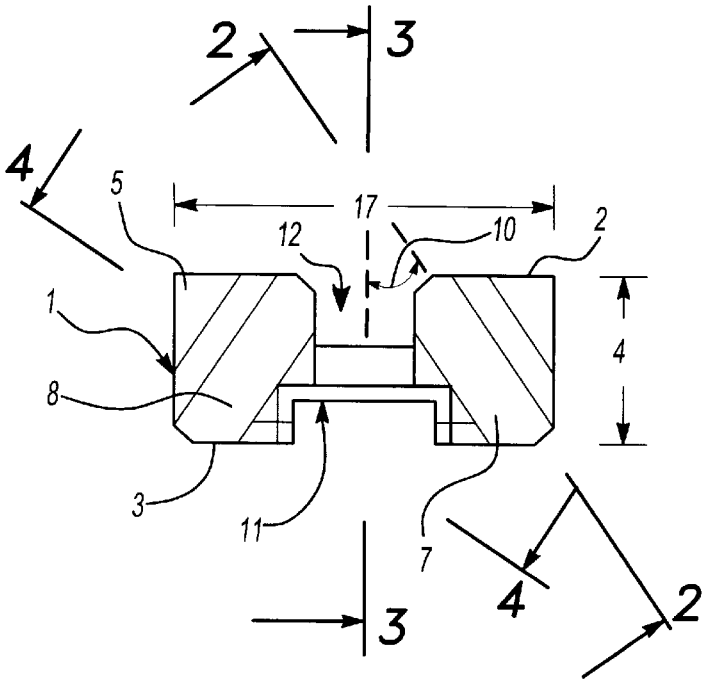
FIG. 1 a front view of a roller cage.

The roller cage 1 has a prismatic basic shape including the rectangular bottom surface 2, the opposing top surface 3, the lateral heights 4, and two opposing faces 5 and 6. The numbering of the top surface 3 and the bottom surface 2 in FIG. 1 refers to the assembled position of the roller cage 1 inside the tool.

Figure 2:
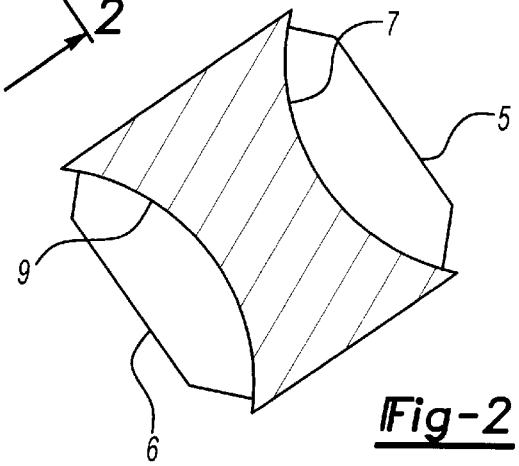
FIG. 2 a cross-section through the leg of a roller cage along the sectioning line A—A, FIG. 3 a longitudinal section along line C—C of FIG. 1, and FIG. 4 a cross-section through the second leg of the roller cage along line B—B.

Two first concave recesses 7 and/or 8, and two second concave recesses 9 and 13 are provided on each of the faces 5 and 6. The concave recesses 7, 8, 9 and 13 are designed to guide work rollers (not shown) on a section of their external circumference. From FIG. 2 it can be seen that the concave recess 7 has a round shape which is required due to the curvature of the work roller. The recess 7 on the face 5 corresponds to a recess 9 on the face 6 as can be clearly seen in FIG. 2. The recesses 7 and 9 always have identical shapes.

Figure 4:
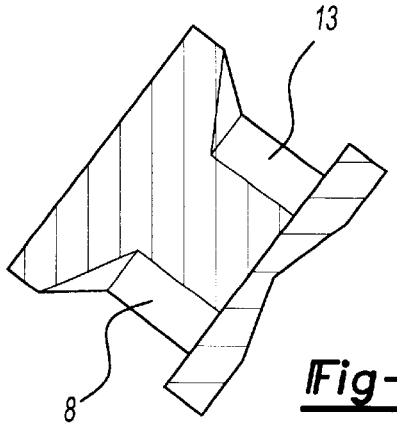

FIG. 1 also shows that the two recesses 7 and 8 are each arranged at an angle 10 from the longitudinal center of the prismatic roller cage 1, which runs along section line C—C. The recess 8 also corresponds to an additional recess 13 of the same kind on the face 6 of the roller cage 1 (FIG. 4).

Figure 3:
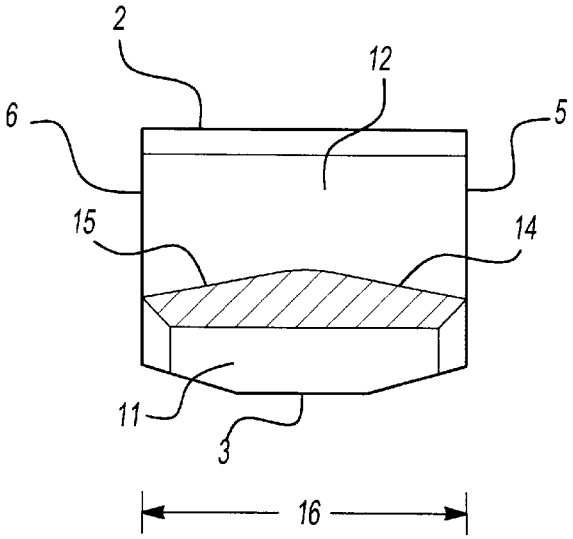

A first, widened, groove shaped recess 11 is provided on the top surface 3 of the prismatic base body of the roller cage 1. This first groove shaped recess 11 runs along the longitudinal center line C—C. When, for example, the tool is assembled, a support roller (not shown) for the work rollers (not shown) engages this first, groove shaped recess 11. Opposite the first groove shaped recess 11, on the bottom surface 2, a second groove shaped recess 12 is provided which also runs along the longitudinal center line C—C of the prismatic roller cage 1. The groove shaped recess 12 is sloped and dropping toward the two faces 5 and 6 as can be clearly seen in the sectional view of FIG. 3. The groove shaped recess 12 is designed to guide the roller cage I on the external end of the long leg of an L-shaped tool holder (not shown). The sloped surfaces 14 and 15 of the groove 12 meet approximately in the center of the longitudinal extension of the prismatic roller cage 1.

From the embodiment described above, it can be seen that, for example, the longitudinal extension 16 of the prismatic roller cage 1 is smaller than its width 17. This relationship has been established regarding the installed position of the prismatic roller cage 1 in the deep rolling tool.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A roller cage for a deep rolling tool for rolling the grooves on crankshaft journals comprising;

a prismatic base body for guiding at least one work roller designed for deep rolling of grooves on crankshaft journals or crank pins, said body having first and second opposing faces;

a first concave recess on said first face for receiving a section of the work roller circumference; and a second concave recess on said second face arranged in a spare position for later use.

2. The roller cage according to claim 1, wherein said first and second concave recesses on first and second faces of the prismatic body are arranged to be mirror images of each other relative to a longitudinal center of the body.

3. The roller cage according to claim 1, wherein said concave recesses each are provided on said first and second faces of the prismatic body.

4. The roller cage according to claim 1, wherein said body includes said second groove shaped recess with a sloped surface dropping toward each of two faces of the prismatic body.

5. The roller cage according to claim 1, wherein said roller cage is made of bronze.

* * * * *

UNITED STATES PATENT AND TRADEMARK OFFICE

CERTIFICATE OF CORRECTION

PATENT NO. : 6,389,861 B1
DATED : May 21, 2002
INVENTOR(S) : Bagusche et al.

It is certified that error appears in the above-identified patent and that said Letters Patent is hereby corrected as shown below:

Title page,
Items [75] and [73], please correct to read:
-- [75] Siegfried Bagusche, Erkelenz; Herbert Kalb, Huckelboven;
Frank Risters, Erkelenz; Hans Zimmerman, Selfkant, all of (DE) --

-- [73] Hegenscheidt-MFD GmbH & Co. KG
Erkelenz (DE) --

Signed and Sealed this

Second Day of September, 2003

JAMES E. ROGAN
*Director of the United States Patent and Trademark Office*